US007271736B2

(12) United States Patent
Siegel et al.

(10) Patent No.: US 7,271,736 B2
(45) Date of Patent: Sep. 18, 2007

(54) EMERGENCY VEHICLE ALERT SYSTEM

(75) Inventors: Michael Aaron Siegel, 303 N. Maple Dr., Beverly Hills, CA (US) 90210; Robert Yarbrough, San Diego, CA (US); William G. Howell, Half Moon Bay, CA (US); Michael J. Serrone, Sunnyvale, CA (US)

(73) Assignee: Michael Aaron Siegel, Beverly Hills, CA (US)

( * ) Notice: Subject to any disclaimer, the term of this patent is extended or adjusted under 35 U.S.C. 154(b) by 202 days.

(21) Appl. No.: 10/769,268

(22) Filed: Jan. 30, 2004

(65) Prior Publication Data

US 2004/0246144 A1 Dec. 9, 2004

Related U.S. Application Data

(63) Continuation of application No. 10/337,690, filed on Jan. 6, 2003, now Pat. No. 6,958,707.

(51) Int. Cl.
*G08G 1/00* (2006.01)

(52) U.S. Cl. ..... 340/902; 340/435; 340/539.21; 340/903; 701/300; 701/301

(58) Field of Classification Search ..... 340/902, 340/901, 903, 904, 436, 539.13, 988, 989; 701/301, 302

See application file for complete search history.

(56) References Cited

U.S. PATENT DOCUMENTS

| | | | | |
|---|---|---|---|---|
| 5,917,430 | A * | 6/1999 | Greneker et al. | 340/905 |
| 6,647,270 | B1 | 11/2003 | Himmelstein | |
| 6,764,495 | B2 * | 7/2004 | Lee et al. | 606/159 |
| 6,765,495 | B1 * | 7/2004 | Dunning et al. | 340/903 |
| 6,853,641 | B2 * | 2/2005 | Lindhorst-Ko et al. | 370/394 |
| 7,092,723 | B2 | 8/2006 | Himmelstein | |

OTHER PUBLICATIONS www.meshdynamics.com.*

* cited by examiner

*Primary Examiner*—Davetta W. Goins
(74) *Attorney, Agent, or Firm*—Koestner Bertani LLP; Mary Jo Bertani

(57) ABSTRACT

An alert transceiver in commuter vehicles in a line-of-site warning area receive line of sight (LOS) alert signals from another vehicle, such as an emergency vehicle. Upon detecting the LOS alert signal, the alert transceiver can relay the alert signals to other alert transceivers in commuter vehicles within a warning zone that are outside of LOS zone, thereby creating mobile tracking network (MTN). The alert signals can include any relevant information, such as information regarding a hazard that includes the type of hazard (emergency vehicle, fire, ambulance, etc.), the time stamped location, direction of travel, speed and planned route for the emergency vehicle; and/or the coordinates of warning zone as determined by alert transceivers.

29 Claims, 8 Drawing Sheets

EMERGENCY VEHICLE ALERT SYSTEM

This application is a continuation of U.S. application Ser. No. 10/337,690 filed Jan. 6, 2003, now U.S. Pat. No. 6,958,707.

BACKGROUND

The field of invention relates to the transmission of signals for emergency vehicles. More specifically, this present invention relates to a system for transmitting signals from emergency vehicles to nearby commuter vehicles.

Various methods and devices have been used to transmit a signal or warning from an emergency vehicle to nearby vehicles, such as the siren of a fire truck or ambulance. Another method involves sending a signal from the emergency vehicle to the traffic light at an upcoming intersection. The traffic light is programmed to turn red in all directions when the traffic light receives the signal.

Sirens have several disadvantages. The volume of the siren limits the distance at which the siren can be heard. Excessive volume can be damaging to the ears of commuters, pedestrians, and the occupants of the emergency vehicle. An additional disadvantage of siren alerts is that commuters have difficulty discerning how many emergency vehicles are in the area or knowing the direction the emergency vehicles are traveling. One emergency vehicle sounding a siren can pass by the commuter vehicle. The commuter may erroneously assume that only one emergency vehicle is in the vicinity and resume travel on the road once the first emergency vehicle passes. In many circumstances, a second emergency vehicle is traveling some distance behind the first emergency vehicle, catching the commuter unaware as he or she enters the path of the second emergency vehicle. Such a situation can force the second emergency vehicle to swerve around the commuter's vehicle, creating a hazard to occupants of the commuter vehicle, the second emergency vehicle, as well as other vehicles in the vicinity.

Another disadvantage associated with the use of sirens is that many commuter vehicles are constructed with a much quieter interior than in past years. The quiet vehicles make it more difficult to hear outside noises, including the blare of a siren. More people live in urban cities and fewer people reside in sparsely traveled rural areas. The cities are densely populated and noisy, which hinders the ability of drivers to adequately hear and discern the siren, above the loud background noises. Additionally, cities have large, tall buildings that block the transmission of the siren sound. The siren sound tends to be funneled down the street. The siren sound does not effectively go around corners. Sound waves can bounce off of buildings and travel around corners to a certain limit, but sound waves do have a tendency to continue travel in the preexisting unobstructed direction.

Sending a signal from the emergency vehicle to a traffic light also has disadvantages. The emergency vehicle transmits a signal to the traffic light at an upcoming intersection. The traffic light responds by turning the traffic signals red in all directions. Commuter traffic is halted, allowing the emergency vehicle to pass easily through the intersection.

Installing the transmitter device on each emergency vehicle is only a small portion of the cost. Each traffic light must have a receiver installed. Installing the receiver on new traffic lights can be expensive. The costs are even more prohibitive when the existing traffic lights need to be retrofitted with a receiver. Coordinating the halting of traffic during the installation can be very time consuming and disruptive to commuters. The cost of retrofitting all of the traffic signals in a city is borne by the city government. The costs can be prohibitive and most cities decline to use the method.

An effective emergency vehicle alert system is very important. Many lives are lost each year in vehicle accidents involving emergency vehicles. Methods and systems are needed that will minimize the risk of the emergency vehicle incurring a collision with a commuter vehicle, which results in injury or death. An emergency vehicle alert system that transmitted a signal farther than the hearing range of a siren would allow commuter vehicles to pull to the side of the road sooner. The roads would be less obstructed and the emergency vehicle could travel faster, reaching the accident scene sooner and delivering patients to treatment centers more rapidly.

Therefore, there is a need for an emergency vehicle alert system that will transmit a signal farther than the hearing range of a siren. Furthermore, there is a need for a system that is affordable to implement. Additionally the emergency vehicle alert system should provide an indication when more than one emergency vehicle is present in the vicinity. The system should also provide an indication of the relative position of the emergency vehicle(s) in relation to the commuter vehicle.

SUMMARY

In some embodiments, an apparatus for alerting occupants in a commuter vehicle to the presence of a plurality of emergency vehicles in the vicinity includes a transceiver operable to receive alert signals transmitted by at least one of the emergency vehicles. A processor is coupled to communicate with the transceiver to relay the alert signals to other commuter vehicles.

In other embodiments, a method for communicating an alert signal from an emergency vehicle to commuter vehicles in a vicinity includes receiving an alert signal transmitted in at least one of the commuter vehicles. A mesh communication network is formed between the commuter vehicles, and the alert signal is relayed from the at least one of the commuter vehicles to a second of the commuter vehicles.

In further embodiments, a system for communicating alert signals among a plurality of vehicles is disclosed, wherein the plurality of vehicles form a mobile network. The system includes an alert transceiver operable to receive the alert signals directly from an object transmitting the alert signals; determine the shape and location of a warning zone in the vicinity of the object transmitting the alert signals; determine one of the plurality of vehicles in the vicinity of the alert transceiver that is within the warning zone; and relay the alert signals to the one of the plurality of vehicles in the vicinity of the alert transceiver.

Although the present invention is briefly summarized, the fuller understanding of the invention is obtained by the following drawings, detailed description, and appended claims.

BRIEF DESCRIPTION OF THE DRAWINGS

These and other aspects, features and advantages of the present invention will become better understood with reference to the accompanying drawing, wherein.

DETAILED DESCRIPTION

Figure 1:
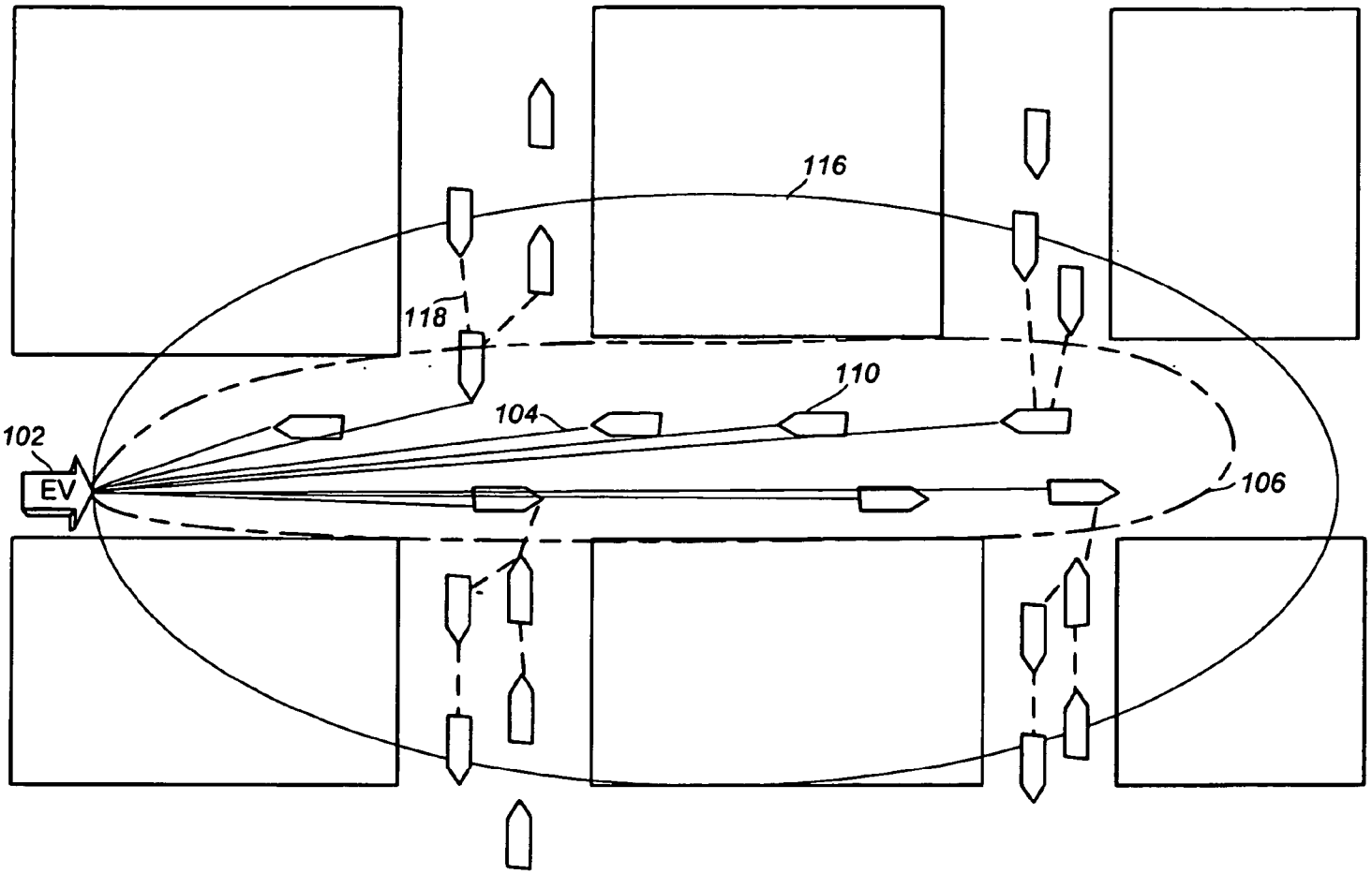
FIG. 1 shows an overhead view of an intersection with emergency vehicles transmitting signals to alert occupants of commuter vehicles of the oncoming presence of the emergency vehicles.

FIG. 1 shows a conceptual view of the operation of an embodiment of Hazard Warning System (HWS) 100 with emergency vehicle 102 configured to transmit line of sight (LOS) alert signals 104 within line-of-sight zone 106 to alert commuter vehicles 110 of the presence of oncoming emergency vehicle 102. For simplicity, a single emergency vehicle 102 is shown broadcasting LOS alert signals 104. Unless otherwise specified, the term commuter vehicle 110 applies to any vehicle that is receiving LOS alert signal 104 or relayed alert signals 118, or transmitting relayed alert signals 118; and the term emergency vehicle 102 applies to any vehicle that is transmitting LOS alert signals 104.

Figure 2:
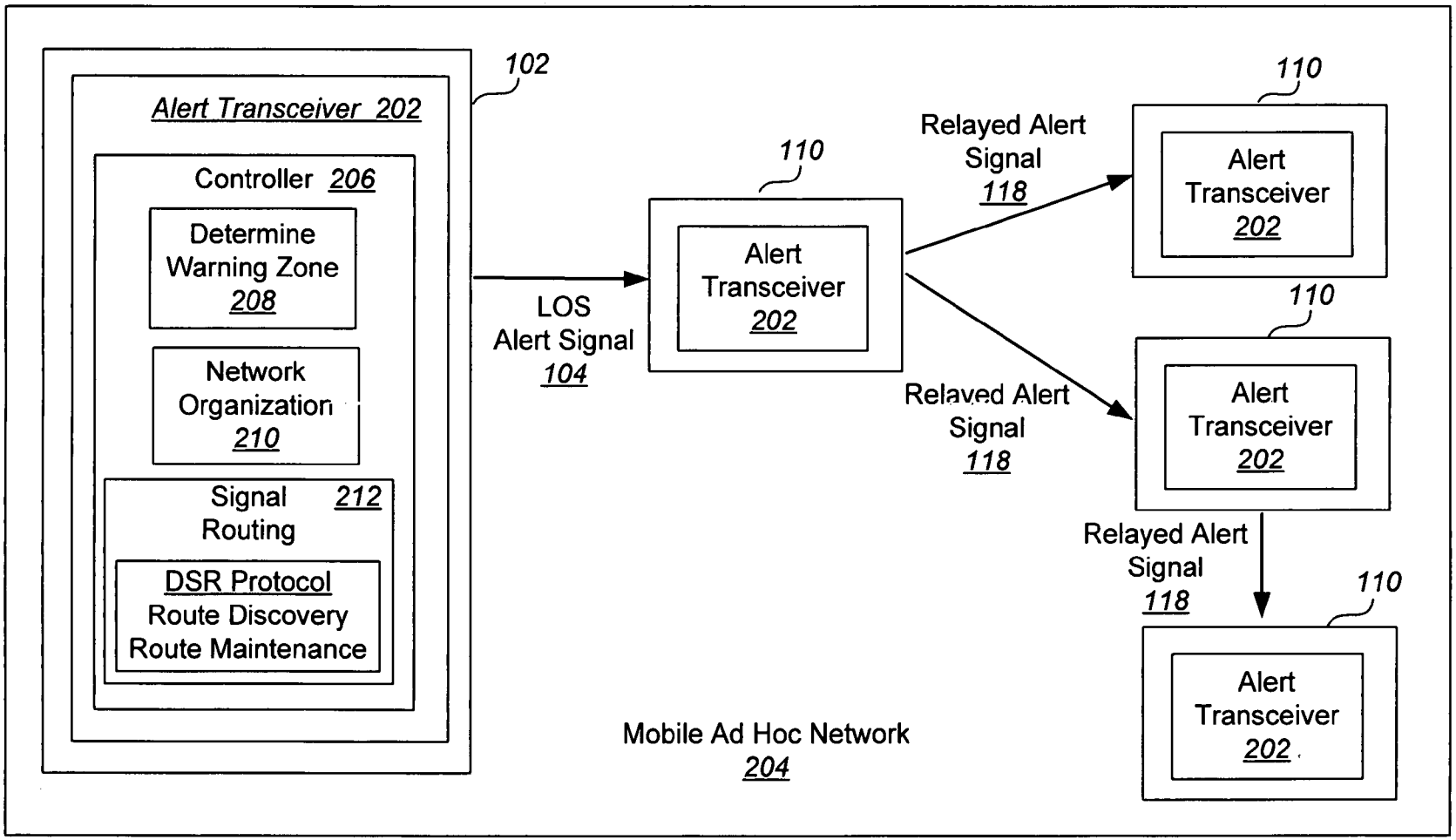
FIG. 2 shows a block diagram of components included in an embodiment of an alert transceiver communicating with alert transceivers in a mobile ad hoc network.

Referring to FIGS. 1 and 2, FIG. 2 shows a conceptual diagram of emergency vehicle 102 and commuter vehicles 110 equipped with alert transceivers 202, which provide transmit and receive communication links to other alert transceivers 202. Commuter vehicles 110 in the line-of-site warning area 106 receive LOS alert signals 104 from the emergency vehicle 102. Upon detecting LOS alert signal 104, commuter vehicles 110 can transmit relayed alert signals 118 to other commuter vehicles 110 within warning zone 116 that are outside of LOS zone 106, thereby creating mobile tracking network (MTN) 204.

Alert signals 104 can include any relevant information, such as information regarding a hazard that include:

- Type of hazard (emergency vehicle, fire, ambulance, etc.);
- Time stamped location, direction of travel, speed and planned route for the emergency vehicle 102; and/or
- Coordinates of warning zone 116 as determined by alert transceivers 202.

All alert transceivers 202 in warning zone 116 can receive this information, but only alert transceivers 202 in commuter vehicles 110 heading toward the path of emergency vehicle 102 will typically respond with a warning to the occupants of the vehicle.

LOS alert signals 104 and relayed alert signals 118 can include unique identifiers that allow alert transceiver 202 to discriminate between LOS alert signals 104 from different emergency vehicles 102. Alert transceivers 202 include logic to distinguish the number and direction of travel of emergency vehicle(s) 102 and to present this information to the occupants.

In some embodiments, alert transceiver 202 initiates MTN 204 by issuing LOS alert signals 104. Alert transceiver 202 includes logic to determine its own position within warning zone 116 and with respect to emergency vehicles 102 from which it has received LOS alert signals 104 and relayed alert signals 118. Since emergency vehicle 102 and commuter vehicles 110 may be moving, warning zone 116 can also move, requiring alert transceivers 202 to dynamically reconfigure MTN 204 so that the appropriate commuter vehicles receive relayed alert signals 118.

The shape of warning zone 116 can be determined by the relative positions, speed, and direction of travel for commuter vehicles 110 and emergency vehicles 102 within a particular vicinity. In some implementations, local map information including environmental features such as buildings and one-way streets, and the planned route for emergency vehicles 102, can be considered in determining whether a particular alert transceiver 202 should transmit relayed alert signals 118 to neighboring vehicles 102, 110. The position, speed, and direction of travel of emergency vehicles 102 and commuter vehicles 110 can also be taken into account to determine the shape of warning zone 116. Information regarding the shape, size, and location of warning zone 116 can be shared among emergency vehicles 102 and commuter vehicles 110.

In some embodiments, warning zone 116 can include all commuter vehicles 110 within a defined distance from the projected path of the particular emergency vehicle 102, as well as vehicles 102, 110 whose velocity and direction will bring them within a defined distance while the emergency vehicle 102 is in the vicinity. For a non-moving hazard (icy bridge, flooded road, accident scene, etc.), warning zone 116 could be a fixed distance around the hazard as determined by suitable local ordinances, public safety officials, or other authority.

Alert transceivers 202 within warning zone 116 form a mesh network of autonomous nodes that communicate with each other by forming a multi-hop radio network and maintaining connectivity in a decentralized manner. Since alert transceivers 202 can communicate over wireless links, they can compensate for the effects of radio communication, such as noise, fading, and interference. Each alert transceiver 202 in MTN 204 can function as both a host and a router, with control of MTN 204 being distributed among alert transceivers 202. The topology of MTN 204 is, in general, dynamic because the connectivity among alert transceivers 202 may vary with time due to vehicle departures and arrivals within warning zone 116.

Alert transceivers 202 include a data processing device, such as controller 206, to execute logic instructions such as determine warning zone instructions 208 that determine the shape and location of warning zone 106; network organization instructions 210 that determine the vehicles 102, 110 that are included in MTN 204; and signal routing instructions 212 that route relayed alert signals 118 between commuter vehicles 110. In some environments, factors such as security, latency, reliability, intentional jamming, and recovery from failure are significant concerns. Accordingly, a suitable communication protocol, such as Dynamic Signal Routing (DSR) protocol, can be used in signal routing instructions 212 to route signals, to enable MTN 204 to be completely self-organizing and self-configuring, without requiring external network infrastructure or administration.

The DSR protocol enables alert transceivers 202 to relay packets of information for each other to allow communication over multiple "hops" between alert transceivers 202 that are not directly within wireless transmission range of one another. As alert transceivers 202 within warning zone 116 move within, and join or leave, MTN 204. As wireless transmission conditions such as sources of interference change, all routing is automatically determined and maintained by the DSR protocol.

Alert transceiver 202 can also include logic instructions to determine when to transition to receiving relayed alert signals 118 from another commuter vehicle 110 in MTN 204. Such a transition may be required when a commuter vehicle 110 from which a particular alert transceiver 202 was receiving alert signals 118 leaves MTN 204. Moreover, alert transceiver 202 can include signal processing logic to compensate alert signals 104, 118 for factors that can distort alert signals 104, 118, such as variable wireless link quality, propagation path loss, fading, multi-user interference, power expended, and topological changes.

To help ensure successful delivery of data packets in spite of movement of alert transceivers 202 or other changes in network conditions, the DSR protocol includes Route Discovery and Route Maintenance logic that work together to allow the discovery and maintenance of information packet routes in MTN 204. Route Discovery can include logic in which a source alert transceiver 202 wishing to send a packet to a destination alert transceiver 202 obtains a source route to destination alert transceiver 202. Route Discovery includes logic that can be used when source alert transceiver 202 attempts to send a packet to destination alert transceiver 202 but does not already know a route to destination alert transceiver 202.

Route Maintenance includes logic by which source alert transceiver 202 is able to detect, while using a source route to destination alert transceiver 202, whether the topology of MTN 204 has changed such that it can no longer use its route to destination alert transceiver 202 because a link along the route is inoperable or is outside warning zone 116. When Route Maintenance indicates a source route is broken, source alert transceiver 202 can attempt to use any other route it happens to know to destination alert transceiver 202, or can invoke Route Discovery again to find a new route for subsequent packets to destination alert transceiver 202. Route Maintenance for this route is typically used only when source alert transceiver 202 is actually sending packets to destination alert transceiver 202.

With the DSR protocol, Route Discovery and Route Maintenance can operate "on demand". In particular, unlike many other communication protocols, the DSR protocol requires no periodic packets of any kind within MTN 204. For example, the DSR protocol does not use any periodic routing advertisement, link status sensing, or neighbor detection packets, and does not rely on these functions from any underlying protocols in MTN 204. This entirely on demand behavior and lack of periodic activity allows the number of transmitted packets to scale down to zero when all alert transceivers 202 are approximately stationary with respect to each other and all routes currently needed for communication have already been discovered. As alert transceivers 202 begin to move more or as communication patterns change, the routing packet overhead of the DSR protocol automatically scales to only that needed to track the routes currently in use. Network topology changes not affecting routes currently in use can be ignored.

All state information maintained by the DSR protocol is discovered as needed and can be rediscovered if needed after a failure without significant impact on MTN 204. This use of dynamic state information allows communication among alert transceivers 202 to be very robust to problems such as dropped or delayed packets or failures of alert transceivers 202. In particular, the DSR protocol can allow an alert transceiver 202 that fails and reboots to easily rejoin MTN 204 immediately after rebooting. If the failed alert transceiver 202 was involved in forwarding packets for other alert transceivers 202 as an intermediate hop along one or more routes, the recovered alter transceiver 202 can also resume this forwarding quickly after rebooting, with no or minimal interruption to network traffic.

A source alert transceiver 202 may learn and cache multiple routes to any destination alert transceiver 202. Supporting multiple routes enables rapid response to routing changes, since an alert transceiver 202 with multiple routes to a destination can try another cached route upon failure of a previously used route. Caching multiple routes also avoids the overhead of discovering a new route each time a route becomes unusable. The source alert transceiver 202 selects and controls the route used for its own packets, which, together with support for multiple routes, also enables features such as load balancing to be performed by controller 206. In addition, loops between alert transceivers 202 can be avoided, since the source alert transceiver 202 can eliminate duplicate hops in the routes selected.

The operation of both Route Discovery and Route Maintenance in the DSR protocol can be implemented to support unidirectional links and asymmetric routes. In particular, it is possible that a link between two alert transceivers 202 may not work equally well in both directions due to differing antenna or propagation patterns, or sources of interference. The DSR protocol allows unidirectional links to be used when necessary, improving overall performance and connectivity in MTN 204.

Figure 3:
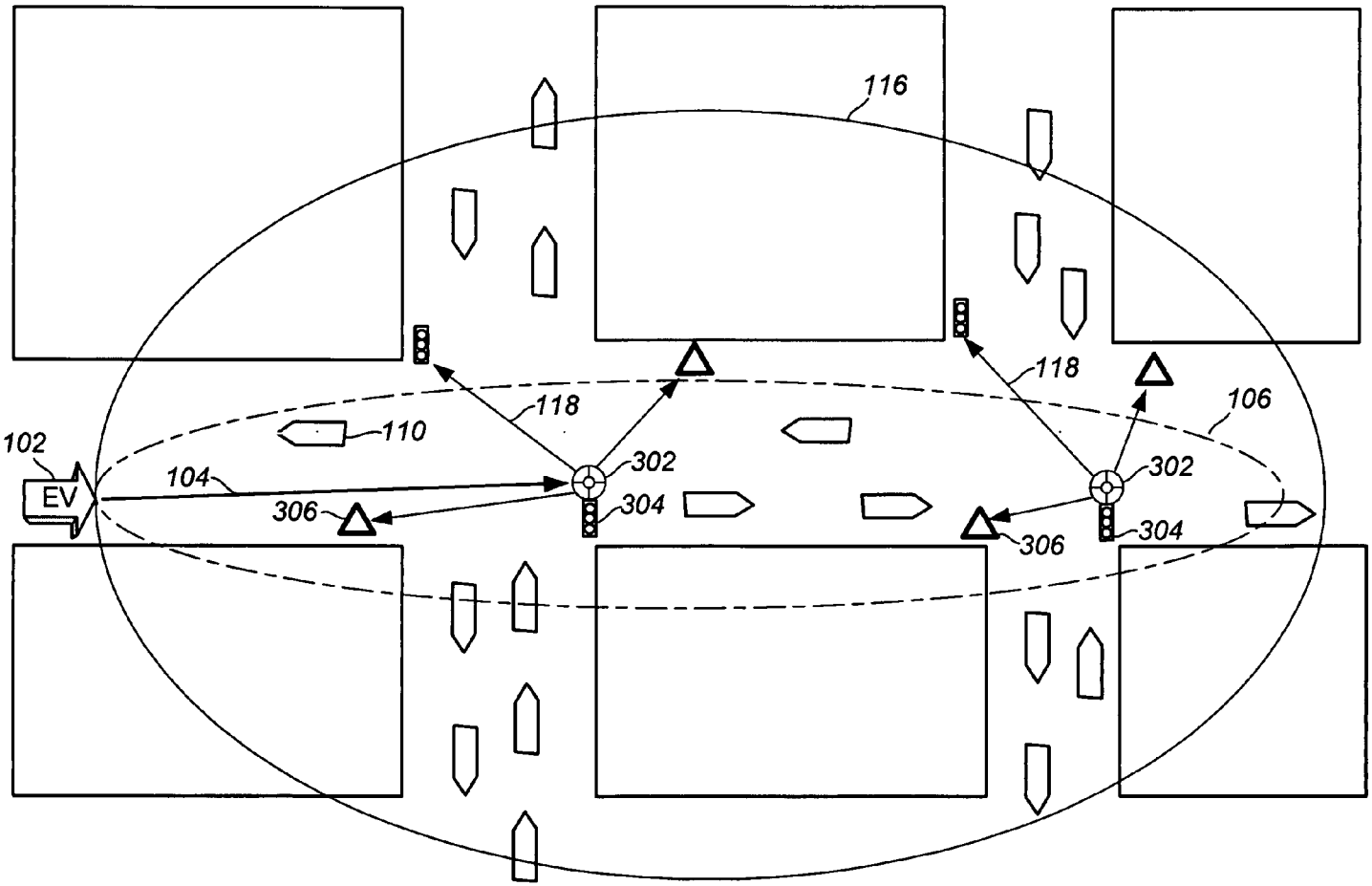
FIG. 3 shows an embodiment of a system for relaying alert signals from emergency vehicles to commuter vehicles via stationary roadside units.

Referring now to FIGS. 2 and 3, FIG. 3 shows another embodiment of an HWS 300 with road-side infrastructure incorporated to alleviate the need for commuter vehicles 110 to be equipped with alert transceivers 202. In some embodiments, roadside units (RSUs) 302 can be installed on traffic lights 304 or other structure at appropriate intersections, and are configured to receive alert signals 104 from emergency vehicles 102. RSUs 302 can initiate a number of actions in response to alert signals 104, such as directly controlling traffic lights 304 to stop cross traffic from entering the path of emergency vehicles 102. RSUs 302 can also control wired or wireless signs 306 along the planned route of emergency vehicle 102 to alert drivers of the approaching hazard. A variety of visual and audio warning indicators, such as a flashing yellow or red light, sirens, and/or text warnings, such as "Pull Over—Emergency Vehicle Approaching", can be implemented to display via signs 306 with RSUs 302. In other embodiments, a combination of alert transceivers 202 in commuter vehicles 110 and emergency vehicles 102, along with RSUs 302, can be utilized. RSUs 302 can relay alert signals 104 from emergency vehicles 102 to commuter vehicles 110 that are outside of LOS zone 106.

Figure 4:
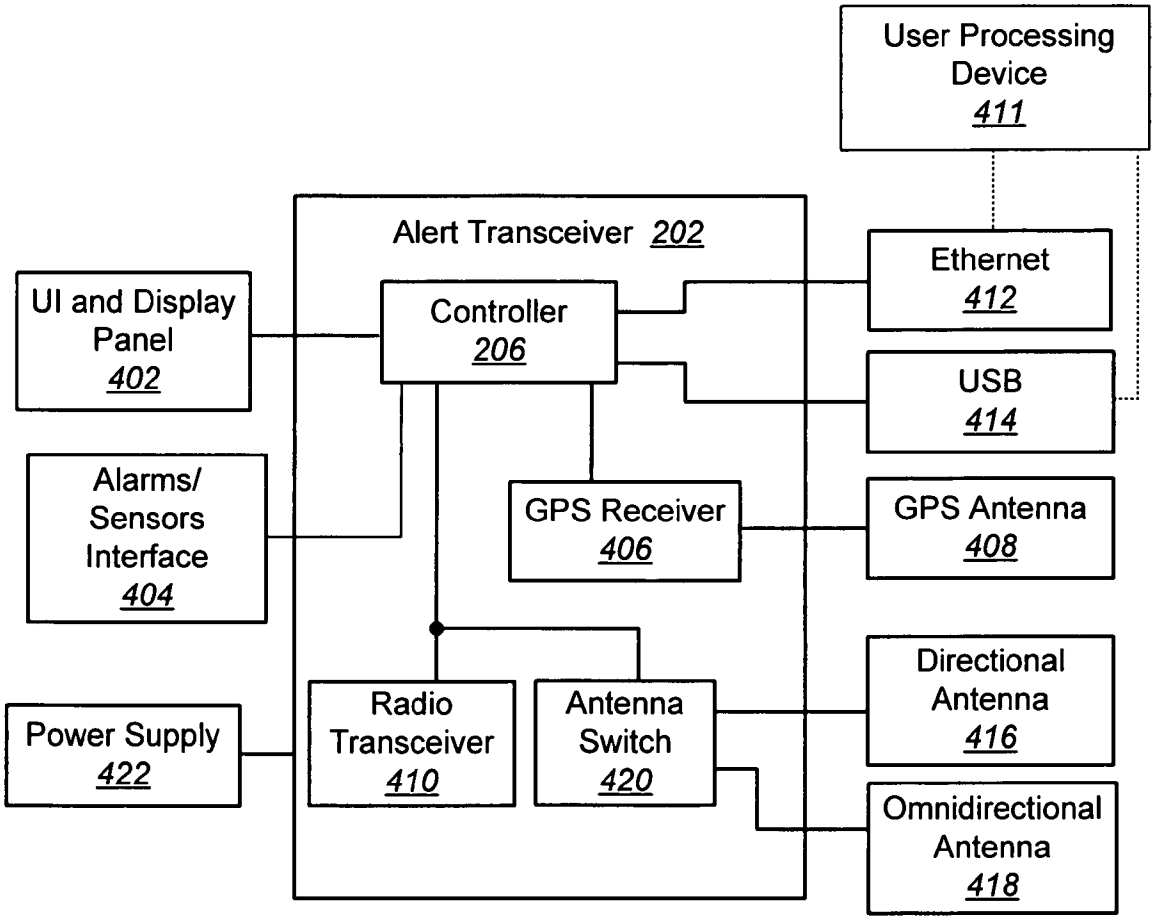
FIG. 4 is a block diagram of components included in an embodiment of alert transceiver.

Referring now to FIGS. 1 and 4, FIG. 4 is a block diagram of components that can be included in an embodiment of alert transceiver 202. In addition to features of controller 206 previously described in connection with FIG. 2, controller 206 can also include features to support the following functions:

- pack and unpack information packets;
- control user interface (UI) and display panel 402;
- receive sensor input including vehicle position, direction and speed via alarm and sensor interface 404;
- receive input from a position sensor system, such as a Global Positioning System (GPS) receiver 406 and GPS antenna 408;
- send and receive data packets via a communication link, such as radio transceiver 410; and
- communicate with user processing device(s) 411 in vehicles 102, 110, such as such as a laptop computer or personal digital assistant (PDA), via a suitable communication interface, such as Ethernet port 412 and/or USB port 414.

An example of a commercially available processing device suitable for use as controller 206 is the ARM 7 processor available from Aeroflex, Inc. in Plainview, N.Y.

Alert transceiver 202 can include a directional antenna 416 aimed in the direction of travel to direct more signal power into line of sight zone 106. An omni-directional antenna 418 can be used when the emergency vehicle 102 or other hazard is stationary. Antennas 416, 418 can be switched manually from UI and display panel 402, or automatically by controller 206, via antenna switch 420.

UI and display panel 402 can include switches, knobs, displays, speakers, and other features to allow the user to control operation of alert transceiver 202 and to present alert information to the occupants of the vehicle in which UI and display panel 402 is installed. UI and display panel 402 can be integral to alert transceiver 202, and/or implemented on a user processing device 411 such as a laptop, telephone with a display area, or PDA, connected to alert transceiver 202 via Ethernet port 412, USB port 414, or other suitable communication interface.

GPS receiver 406 can determine the geographic position of a vehicle utilizing signals transmitted from GPS satellites. GPS receiver 406 provides information regarding the vehicle's latitude, longitude, and altitude. Position information from GPS receiver 406 can be included in alert signals 104, 118. Notably, since GPS positions are typically accurate to within a few feet, position information can be used to uniquely identify emergency vehicle 102. The GPS components of alert signals 104, 118 are detected by alert transceiver 202, which can indicate the location of emergency vehicles 102 in relation to commuter vehicles 110 on UI and display panel 402 or other suitable device. UI and display panel 402 can include a display that shows the position of emergency vehicles 102 relative to commuter vehicle(s) 110, with or without a map. As the vehicle moves, the position of the vehicle is updated on the map. Any suitable GPS antenna 408 and receiver 406, such as U-blox Module TIM-ST-0-000-5, commercially available from Linkwave Technologies, Ltd. in the United Kingdom, can be utilized with alert transceiver 202.

Power supply 422 provides voltage at one or more suitable levels to operate components in alert transceiver 202. Any suitable type(s) of power supply 422 can be utilized, such as one or more rechargeable or non-rechargeable batteries, and/or an interface to an alternator and generator that provide power to alert transceiver 202 while the vehicle's engine is running.

Alert transceiver 202 can receive destination information for emergency vehicle 102 from the user via UI and display panel 402, and determine an optimized route between the vehicle's current location and the destination. Alert transceiver 202 can also receive identity, position, speed, and route information from relayed alert signals 118 received from another commuter vehicle 110, and present it to occupants in the receiving vehicle via UI and display panel 402.

Controller 206 can also access a map database (not shown) to estimate the time emergency vehicle 102 will arrive at various intersections along the route, and transmit the information to commuter vehicles 110 via alert signals 104, 118. Information regarding emergency vehicle 102, such as position, speed, direction, and route can be updated periodically in commuter vehicle 110 from information sent by emergency vehicle 102, or sensor systems capable of monitoring the progress of emergency vehicles 102 along their route. Alert transceiver 202 can also include logic to control stop light signals and other signs in the appropriate directions along the route and at intersections to be traveled by emergency vehicle 102. Authorization and security logic can be included in alert transceiver 202 to prevent unauthorized users from controlling traffic signals and emitting alert signals 104.

Alert signals 104, 118 can include data that uniquely identifies emergency vehicles 102 and commuter vehicles 110 to other alert transceivers 202. When controller 206 receives data that identifies oncoming emergency vehicle(s) 102, controller 206 outputs information to UI and display panel 402 to notify the occupants in the corresponding vehicle 102, 110. Controller 206 can access a map database and extrapolate the time emergency vehicle 102 will arrive in a vicinity. In some embodiments, UI and display panel 402 includes a monitor screen capable of presenting a visually display of emergency vehicle 102 and, in some embodiments, other commuter vehicles 110. The monitor screen can be incorporated in the same packaging unit as alert transceiver 202 or be packaged separately. Additionally, UI and display panel 402 can be integrated in an existing system such as a vehicle navigation system capable of receiving and displaying input from alert transceiver 202, and transmitting user input to alert transceiver 202.

Awareness of emergency vehicle(s) 102 in the vicinity allows drivers of commuter vehicles 110 to take appropriate action. The notification can be a light, voice recording, alpha-numeric display, flashing or continuously displayed symbol on a map, or other suitable methods and devices for presenting the alert information. A combination of notification warnings can be used. The voice warning can be selected from an array of digitized voice recordings. Any one of the digitized voice recordings can be selected based on a user's preference. Volume, severity of tone, gender of the voice, and wording of the warning message can all be selected based on the driver's preference. As an additional feature, the voice warning can be recorded by the user with their own voice.

Controller 206 provides information to UI and display panel 402 to indicate the number of emergency vehicle 102 in the vicinity, based on identification information in alert signals 104, 118. Alert signals 104 can include any type of relevant information, such as speed, location, and direction of travel along with identification information. As signals 104, 118 are no longer transmitted within the detection range of alert transceiver 202, controller 206 can discontinue presenting information regarding the corresponding emergency vehicle 102.

When alert transceiver 202 no longer detects any alert signals 104, 118, an all-clear notification can be presented on UI and display panel 402. The commuter can safely resume travel when all emergency vehicles 102 have departed from the immediate vicinity.

Alarm and sensor interface 404 can interface with one or more sensor systems, such as a speedometer, RADAR sensor system, and forward looking infrared (FLIR) system. Controller 206 can include logic instructions that determine the strength of the alert signals 104, 118 based on the speed of the emergency vehicle 102 and/or commuter vehicles 110. Additionally, alert transceiver 202 can adjust the strength of relayed alert signals 118 based on the speed of commuter vehicles 110.

Further, alert transceiver 202 can include a long-range high speed setting that is manually selectable by the driver via UI and display panel 402. The high-speed setting can cause alert signals 104 to be transmitted over a greater distance to provide advance warning to commuter vehicles 110 of an emergency vehicle 102 approaching their vicinity.

The high-speed setting can be initiated as part of the step of activating an initiation switch on UI and display panel 402 in an emergency vehicle 102, or automatically once emergency vehicles 102 reach a certain speed.

Alert transceiver 202 ceases detecting alert signals 104 as each corresponding emergency vehicle 102 passes commuter vehicle 110. An all-clear indicator can be presented to let the occupants of commuter vehicles 110 know when they can proceed along their route. As a result, there is no unnecessary delay to occupants of commuter vehicle 110 after the last emergency vehicle 102 has safely passed.

Other embodiments of alert transceiver 202 can include fewer components or additional components, depending on the functions to be performed and the distribution of functions among components. Components in alert transceiver 202 can be configured in any suitable wireless local area network (WLAN) chipset, such as those commercially available from companies such as Broadcom in Irvine, Calif., and Texas Instruments in Dallas, Tex. Any suitable and communication protocol, such as a communication protocol that follows the Institute of Electronics and Electrical Engineers (IEEE) 802.11 wireless standard, can be used for alert transceiver 202. Alert signals 104, 118 can be transmitted by alert transceiver 202 using one or more radio frequencies. Information in alert signals 104, 118 can be updated frequently to provide real-time information to commuter vehicles 110. Alert transceiver 202 can have any suitable shape, size, and interface configuration. In some embodiments, standard form factors such as Peripheral Component Interconnect (PCI), Mini PCI, Universal Serial Bus (USB), and Cardbus form factors are used.

Figure 5:
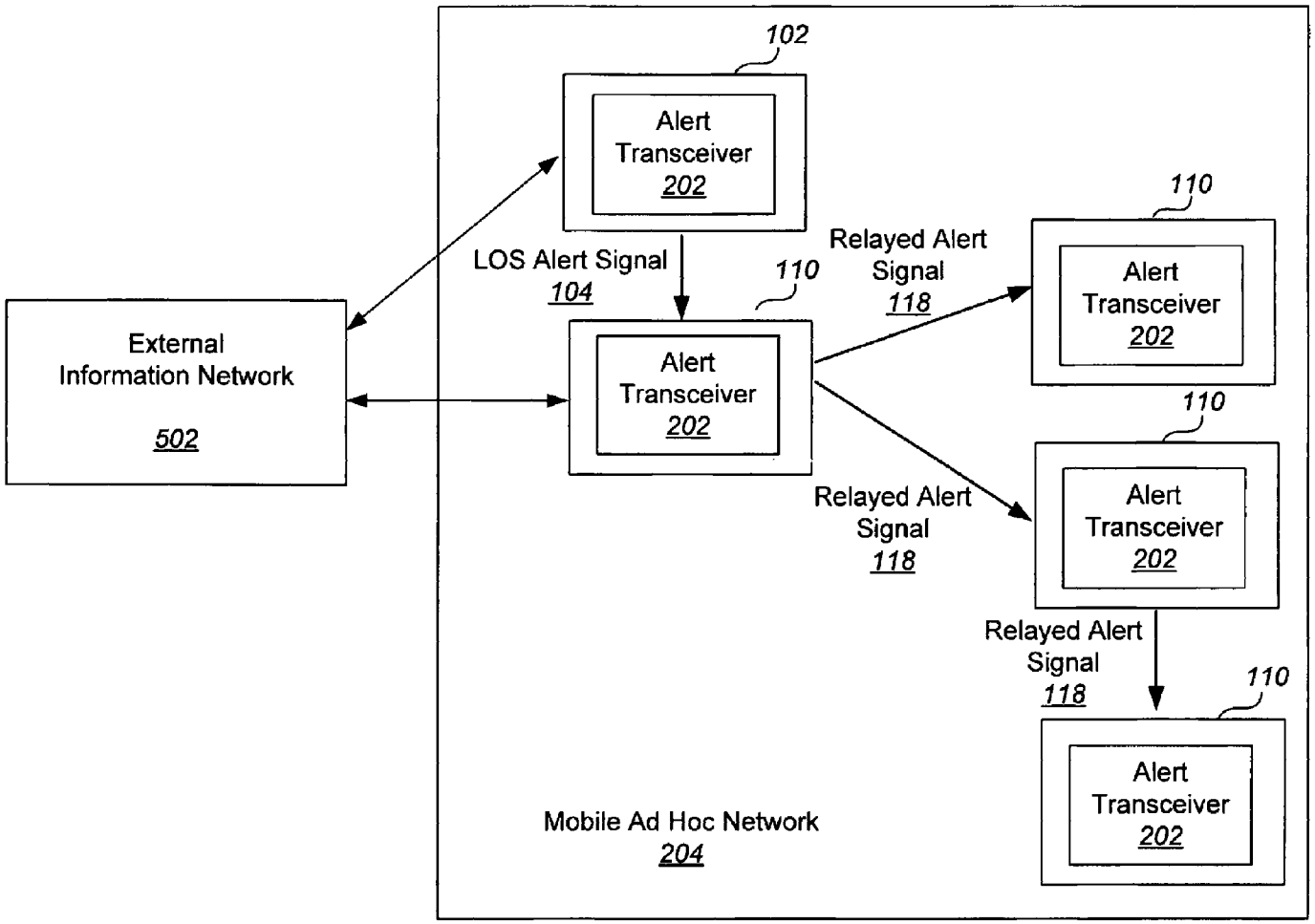
FIG. 5 is a block diagram of an embodiment of alert transceivers configured to communicate with an external information network.

Referring now to FIG. 5, one or more alert transceivers 202 can be configured to communicate with an external information network 502, such as the Internet. Information can be transmitted to and received from network 502 via any suitable user processing devices 411 and/or UI and display panel 402 (FIG. 4). Accordingly, user processing devices 411 and/or UI and display panel 402 can include suitable interface facilities such as network browser and electronic mail programs. Information to and from network 502 can be transmitted and received in any suitable format such as text, image, and audio formats. Information to and from network 502 can also be relayed and shared between alert transceivers 202 in MTN 204

Figure 6A:
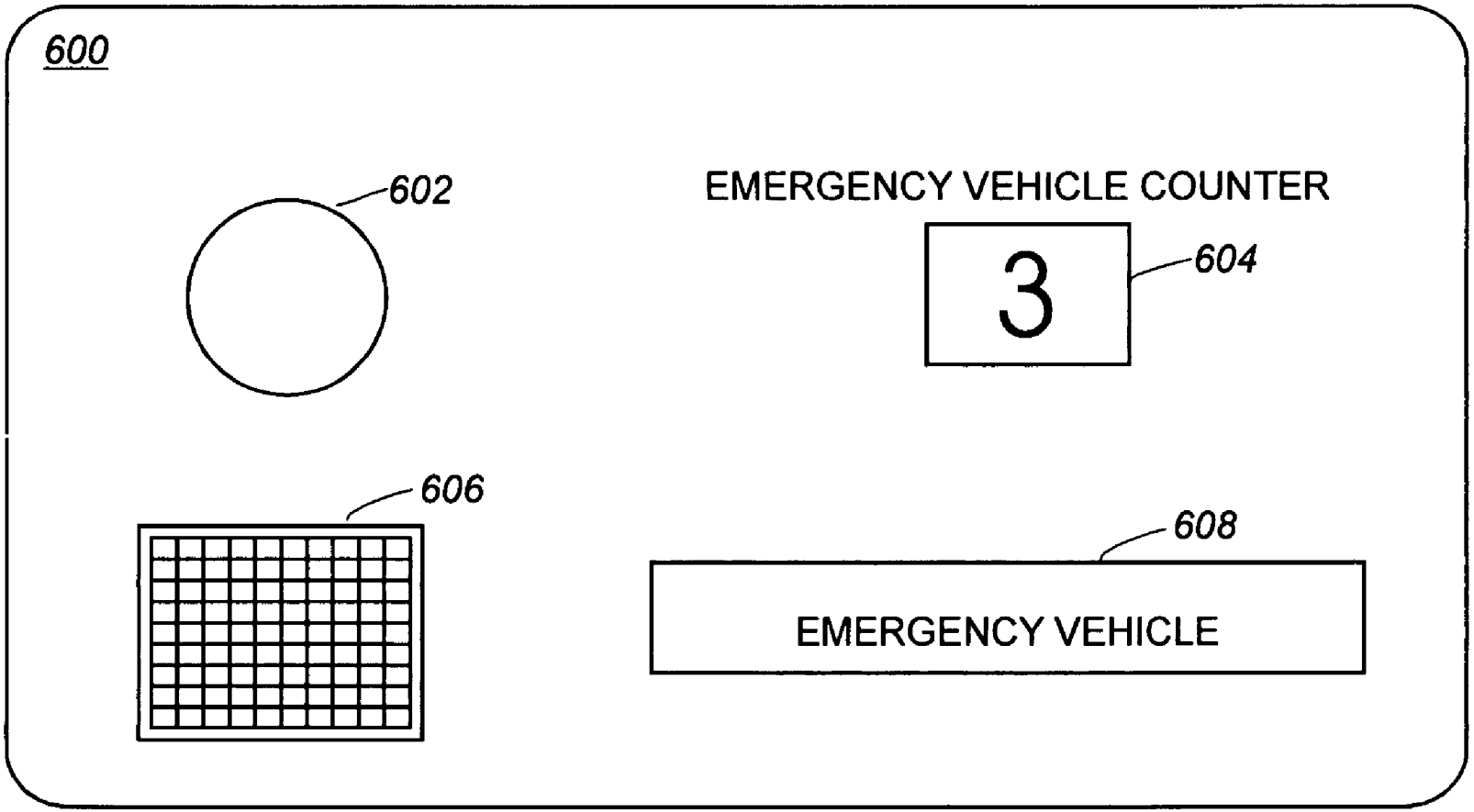
FIGS. 6A, 6B, and 6C show alternate embodiments of audio and visual displays for presenting alert signal information to occupants of commuter vehicles.
Figure 6B:
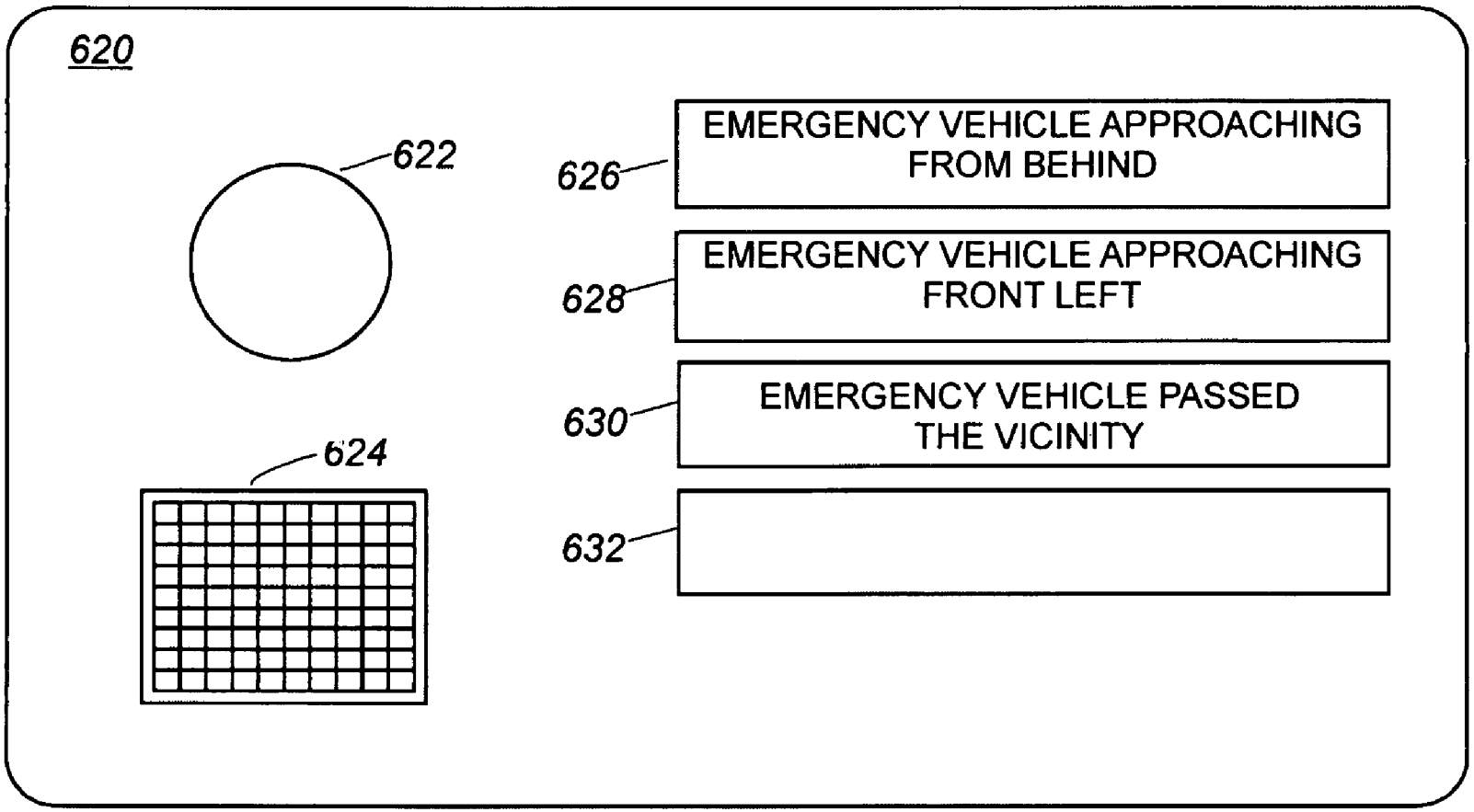
Figure 6C:
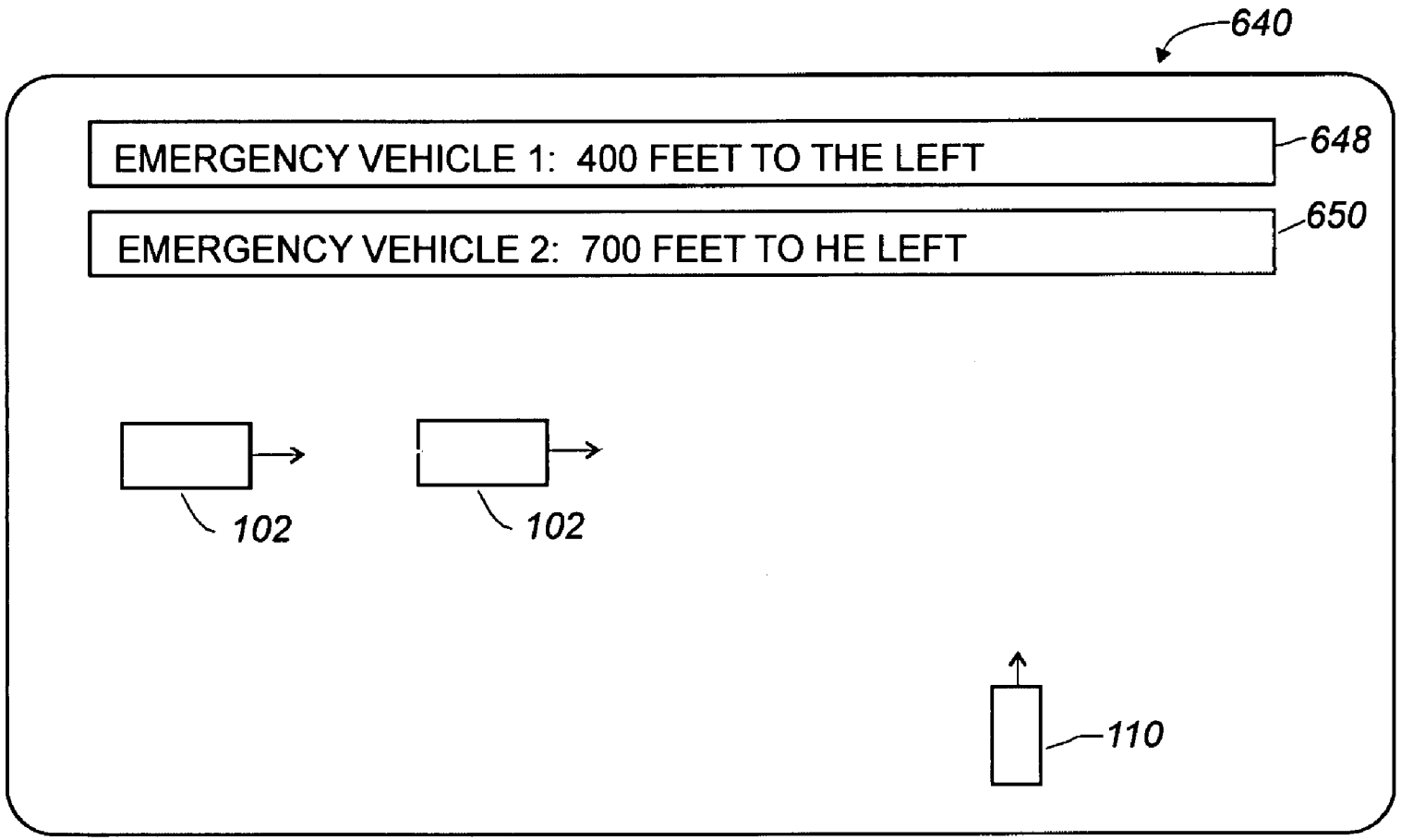

FIG. 6A shows an embodiment of UI and display panel 402 for presenting alert signal information to occupants of commuter vehicle 110, as well as emergency vehicles 102. An azimuth indicator 602 with visual indicators, such as radially spaced light emitting diodes (LEDs), can be included to indicate the location and/or direction of travel of emergency vehicle(s) 102 in relation to commuter vehicle 110. Corresponding LEDs are activated/deactivated as the position and direction of emergency vehicle 102 change relative to commuter vehicle 110. An emergency vehicle counter 604 can be implemented with any suitable device, such as a liquid crystal display (LCD), to indicate the number of emergency vehicles 102 in the vicinity. Audible warnings can be issued through speaker 606, while another readout display 608 can provide more specific information regarding the source of the alert signals. For example, a message indicating that emergency vehicles 102 are approaching can be displayed while emergency vehicle 102 are in the vicinity. An all-clear message can be displayed once emergency vehicles 102 have passed and the commuter vehicle 110 can proceed.

UI and display panel 402 can also include a visual indicator 622, such as a light, to indicate the presence of emergency vehicle 102 in the vicinity of commuter vehicle 110. Visual indicator 622 can utilize different colors, such a red to indicate an alert situation, or green to indicate an all-clear condition. Audible warnings can be issued through speaker 624, while a series of readout displays 626 to 632 can provide more specific textual information regarding the position and direction of approaching emergency vehicle 102. Once emergency vehicles 102 have passed, visual indicator 622 is extinguished, and readout displays 626 to 632 are cleared or present an all-clear message.

A monitor with 634 can be used to present symbols to indicate the number, location, speed, and/or direction of travel of emergency vehicles 102 in relation to commuter vehicle 110. Audible warnings can be issued through speaker 606, while readout displays 648, 650 can provide more specific information regarding emergency vehicles 102. For example, a message indicating the distance of emergency vehicles 102 from commuter vehicle 110 can be displayed while emergency vehicles 102 are in the vicinity. An all-clear message can be displayed once emergency vehicles 102 have passed and commuter vehicle 110 can proceed.

Additionally, or alternatively, information from alert signals 104 can be presented utilizing systems already installed in commuter vehicle 110, such as car audio systems, dashboard lights, and navigation systems with moving map displays.

Emergency vehicle 102 can include police cars, fire trucks, and ambulances, to name a few examples, as well as any other type of vehicle where one or more vehicles transmit a signal to a receiver in another vehicle. For instance, alert transceivers 202 can be located at railroad crossings and activated, either manually or automatically, when a train is within a specified distance. The alert signals would be broadcast in a pattern designed to reach commuter vehicles 110 approaching the tracks from any direction in the vicinity.

The advantages of HWS 100 are numerous. HWS 100 can transmit alert signals 104 at ranges based on the speed of travel whereas only the volume of a siren can be adjusted to increase the distance projection. An indication of the number emergency vehicle 102 in the vicinity of commuter vehicle 110 is provided. HWS 100 can be implemented on a nationwide basis to promote uniformity of components and alert signal transmission frequency(s). Additionally, commuter vehicles 110 are provided with information regarding the position of emergency vehicles 102 relative to commuter vehicles 110. HWS 100 can also be implemented using existing communication infrastructures.

HWS 100 can be used in a variety of applications including providing warning of approaching emergency response vehicles; hazard warning for vehicles involved in an accident; and warnings for disabled vehicles, temporary detour routes, railroad grade crossings, highway and road construction zones, and traffic backups. Further, a combination of stationary and mobile alert transceivers 202 can be utilized.

Logic instructions can be stored on a computer readable medium, or accessed in the form of electronic signals. The logic modules, processing systems, and circuitry described herein may be implemented using any suitable combination of hardware, software, and/or firmware, such as Field Programmable Gate Arrays (FPGAs), Application Specific Integrated Circuit (ASICs), or other suitable devices. The logic modules can be independently implemented or included in one of the other system components. Similarly, other components are disclosed herein as separate and discrete components. These components may, however, be combined to form larger or different software modules, logic modules, integrated circuits, or electrical assemblies, if desired.

While the invention has been described with reference to various embodiments, it will be understood that these embodiments are illustrative and that the scope of the invention is not limited to them. Many variations, modifications, additions and improvements of the embodiments described are possible. For example, those having ordinary skill in the art will readily implement the steps necessary to provide the structures and methods disclosed herein. Further, functions performed by various components can be implemented in hardware, software, firmware, or a combination of hardware, software, and firmware components. Variations and modifications of the embodiments disclosed herein may be made based on the description set forth herein, without departing from the scope of the invention as set forth in the following claims.

In the claims, unless otherwise indicated the article "a" is to refer to "one or more than one".

What is claimed is:

1. An apparatus for alerting occupants in a commuter vehicle to the presence of a plurality of emergency vehicles in the vicinity, comprising:

a transceiver operable to receive alert signals transmitted by at least one of the emergency vehicles;

a processor coupled to communicate with the transceiver, wherein the processor is operable to:

relay the alert signals to other commuter vehicles, determine the commuter vehicles and the at least one emergency vehicle included in a mobile network, and dynamically determine routes for relaying the alert signals to other commuter vehicles as the commuter vehicles enter and leave the mobile network.

2. The apparatus of claim 1, wherein the processor is further operable to determine a warning zone in which the alert signals will be relayed.

3. The apparatus of claim 1, wherein the signals include information regarding the location of the at least one emergency vehicle, and the processor is further operable to update a display representing the position of the at least one emergency vehicle in relation to the commuter vehicle.

4. The apparatus of claim 1, wherein the processor is further operable to activate an all-clear indicator when the at least one emergency vehicle has traveled past the location of the commuter vehicle.

5. The apparatus of claim 1 wherein the alert signals are radio frequency signals.

6. The apparatus of claim 1 wherein the alert signals include at least one of: position, speed, direction of travel, and route information for the at least one emergency vehicle.

7. The apparatus of claim 1, wherein the strength of the alert signals indicate the position of the at least one emergency vehicle relative to the commuter vehicle.

8. The apparatus of claim 1, further comprising a directional antenna operable to transmit the alert signals in a desired direction.

9. The apparatus of claim 1, wherein the alert comprises at least one of: a voice warning, a light, an alphanumeric display, and a symbol on a map display.

10. The apparatus of claim 1, further comprising a communication protocol operable to discover routes for relaying the alert signals between the commuter vehicles, and to update the routes as commuter vehicles enter and leave the mobile network.

11. The apparatus of claim 1, further comprising an interface operable to communicate with a user processing device.

12. A method for communicating an alert signal from an emergency vehicle to commuter vehicles in a vicinity, comprising:

receiving an alert signal transmitted in at least one of the commuter vehicles;

forming a mesh communication network between the commuter vehicles;

relaying the alert signal from the at least one of the commuter vehicles to a second of the commuter vehicles in the mesh network; and caching multiple routes to a destination within the mesh communication network.

13. The method of claim 12, further comprising relaying the alert signal from the one of the other commuter vehicles to a second one of the other commuter vehicles.

14. The method of claim 12, further comprising determining a warning zone, wherein the commuter vehicles within the warning zone are included in the mobile network.

15. The method of claim 12, further comprising activating an all-clear indicator when all of the emergency vehicles have traveled past the location of the commuter vehicle.

16. The method of claim 12 further comprising determining routes for relaying the alert signal to the other commuter vehicles as commuter vehicles enter and leave the mobile network.

17. The method of claim 12, further comprising discovering routes for relaying the alert signals between the commuter vehicles, and updating the routes as commuter vehicles enter and leave the mobile network.

18. The method of claim 17, directing transmission of the alert signal to a desired area.

19. The method of claim 12, wherein the alert comprises at least one of the group of: a voice warning, a light, an alphanumeric display, and a symbol representing the position of the emergency vehicle in relation to the commuter vehicle.

20. The method of claim 12, further comprising outputting the alert to a user processing device.

21. The method of claim 17, further comprising supporting unidirectional communication between two commuter vehicles.

22. The method of claim 17, further comprising activating an all-clear indicator when the emergency vehicle has traveled past the location of the commuter vehicle.

23. A system for communicating alert signals among a plurality of vehicles, wherein the plurality of vehicles form a mobile network, the system comprising:

an alert transceiver operable to:

receive the alert signals directly from an object transmitting the alert signals;

determine the shape and location of a warning zone in the vicinity of the object transmitting the alert signals;

determine one of the plurality of vehicles in the vicinity of the alert transceiver that is within the warning zone; and relay the alert signals to the one of the plurality of vehicles in the vicinity of the alert transceiver.

24. The system of claim 23, further comprising a directional antenna operable to transmit the alert signals in a selected area.

25. The system of claim 23, further comprising a user interface and display panel operable to receive input from a user and to present information from the alert signals in a format detectable by the user.

26. The system of claim 23, further comprising a directional antenna operable to transmit the alert signals in a selected area; an omni-directional antenna operable to transmit the alert signals in all directions; and an antenna switch operable to select between use of the directional and the omni-directional antennas.

27. The system of claim 23, further comprising an interface operable to communicate with a user processing device.

28. The system of claim 23, wherein the alert transceiver is further operable to:

receive relayed alert signals from one of the plurality of vehicles;

determine another of the plurality of vehicles in the vicinity of the alert transceiver that is within the warning zone and that has not received the alert signals; and relay the alert signals to the another of the plurality of vehicles.

29. The system of claim 23, wherein the object transmitting the alert signal is an emergency vehicle and the alert transceiver is further operable to activate an all-clear indicator when the emergency vehicle has traveled past the alert transceiver.

* * * * *